US007722744B2

(12) United States Patent
Mueller et al.

(10) Patent No.: US 7,722,744 B2
(45) Date of Patent: May 25, 2010

(54) PRESSING DEVICE

(75) Inventors: Jens Mueller, Ravensburg (DE); Ewald G. Welp, Duesseldorf (DE); Andreas Schuette, Heidenheim (DE); Dimitrios Giannoulis, Homburg (DE); Ralf Pfifferling, Gerstetten (DE); Wolfgang Meyer-Grevendick, Essen (DE)

(73) Assignee: Voith Paper Patent GmbH, Heldenheim (DE)

( * ) Notice: Subject to any disclaimer, the term of this patent is extended or adjusted under 35 U.S.C. 154(b) by 759 days.

(21) Appl. No.: 10/595,599

(22) PCT Filed: Oct. 26, 2004

(86) PCT No.: PCT/EP2004/012099

§ 371 (c)(1),
(2), (4) Date: Apr. 28, 2006

(87) PCT Pub. No.: WO2005/042834

PCT Pub. Date: May 12, 2005

(65) Prior Publication Data

US 2007/0051250 A1 Mar. 8, 2007

(30) Foreign Application Priority Data

Oct. 31, 2003 (DE) ..... 103 51 294

(51) Int. Cl.

| | |
|---|---|
| ***D21F 3/06*** | (2006.01) |
| ***D21F 3/02*** | (2006.01) |
| ***B30B 5/02*** | (2006.01) |
| ***B30B 15/22*** | (2006.01) |

(52) U.S. Cl. ..... 162/358.3; 162/205; 100/118; 100/185

(58) Field of Classification Search ..... 162/204, 162/205, 358.1, 358.3; 100/37, 118, 153, 100/156, 185, 186
See application file for complete search history.

(56) References Cited

U.S. PATENT DOCUMENTS

| | | | | |
|---|---|---|---|---|
| 3,974,026 | A * | 8/1976 | Emson et al. | 162/358.3 |
| 4,576,682 | A * | 3/1986 | Laapotti | 162/358.3 |
| 4,586,983 | A * | 5/1986 | Laapotti | 162/205 |
| 4,713,147 | A | 12/1987 | Saarinen | |

(Continued)

FOREIGN PATENT DOCUMENTS

| | | | |
|---|---|---|---|
| DE | 4307137 | * | 8/1993 |

(Continued)

OTHER PUBLICATIONS

DE 4307137, English language machine translation, European Patent Office.*

(Continued)

*Primary Examiner*—Eric Hug
(74) *Attorney, Agent, or Firm*—Greenblum & Bernstein, P.L.C.

(57) ABSTRACT

The invention relates to a device (12) which is used to press a pressure shoe (10) against a counter surface, comprising at least one at least partially flexible pressure body (16) which is supported on the bearing body (14), said pressure body comprising at least one cavity (18) which can be impinged upon by pressure fluid in order to produce a predetermined pressing force over a corresponding pressure body volume.

44 Claims, 7 Drawing Sheets

U.S. PATENT DOCUMENTS

| | | | | | |
|---|---|---|---|---|---|
| 5,507,916 | A | * | 4/1996 | Schiel | 162/195 |
| 5,662,777 | A | * | 9/1997 | Schiel et al. | 162/358.3 |
| 5,980,693 | A | * | 11/1999 | Liang et al. | 162/358.3 |
| 6,045,658 | A | | 4/2000 | Alheid | |
| 6,334,933 | B1 | * | 1/2002 | Koski | 162/358.3 |
| 6,554,964 | B2 | * | 4/2003 | Brox | 162/358.3 |
| 6,746,574 | B2 | * | 6/2004 | Scherb et al. | 162/205 |
| 2002/0069995 | A1 | * | 6/2002 | Scherb et al. | 162/358.3 |
| 2004/0134632 | A1 | * | 7/2004 | Scherb et al. | 162/358.3 |
| 2004/0194904 | A1 | * | 10/2004 | Scherb et al. | 162/358.3 |
| 2004/0261967 | A1 | * | 12/2004 | Scherb et al. | 162/205 |

FOREIGN PATENT DOCUMENTS

| | | | |
|---|---|---|---|
| DE | 4321400 | * | 11/1993 |
| DE | 195 14 142 | * | 7/1996 |
| DE | 19616800 | | 11/1997 |
| DE | 19724500 | | 10/1998 |
| DE | 19860687 | | 7/2000 |
| EP | 0752495 | * | 1/1997 |
| EP | 98/42997 | | 10/1998 |
| JP | 2001-132734 | * | 5/2001 |
| WO | WO 92/13134 | * | 8/1992 |
| WO | 2004/035914 | | 4/2004 |
| WO | 2004/079090 | | 9/2004 |

OTHER PUBLICATIONS

DE 4321400, Nov. 1993, English machine translation [retrieved from ep.espacenet.com Jun. 12, 2009].*

* cited by examiner

PRESSING DEVICE

BACKGROUND OF THE INVENTION

1. Field of the Invention

The invention relates to a device for pressing a pressure shoe against a backing surface.

2. Background Description

A pressure shoe of this type can, in particular, be part of a shoe press unit, in particular of a shoe roll, and serve to press a flexible belt or flexible press cover for forming a press nip which is extended in the web running direction against a backing surface which is formed, for example, by a backing roll. A corresponding shoe press unit can be provided, for example, for manufacturing and/or treating a fibrous web, in particular a paper or paperboard web. Here, the fibrous web can be guided through the relevant press nip together with at least one felt or fabric.

Up to now, the pressure shoe was pressed on either by an oil pressure bed or separate pressing pistons. However, an oil pressure bed causes problems, in particular, with regard to sealing. The use of separate pressing pistons is associated with the disadvantage of a deviation in the transverse pressure profile which is caused by the individual pistons.

SUMMARY OF THE INVENTION

The invention is based on the aim of providing an improved pressing device of the type which is mentioned in the introduction, in which the abovementioned problems are eliminated. Here, in particular, a relatively uniform pressure distribution in the machine running direction and in the transverse direction is to be made possible, in order to achieve a pressure profile which is as planar as possible. The occurrence of reaction forces in the machine running direction and transverse direction is to be reduced to a minimum.

According to the invention, this aim is achieved by the fact that the device comprises at least one pressure element which is supported on a supporting body, is flexible at least in regions and has at least one hollow space which can be acted on with pressure fluid, in order to produce a predefinable pressing force via a corresponding pressure element volume. Here, the pressure element is preferably configured to be leakfree.

On account of this embodiment, a relatively uniform pressure distribution is possible in the machine running direction and transverse direction, with the result that pressure profiles which are as planar as possible can be produced. This therefore results in a relatively large pressing surface which faces the pressure shoe or its lower part, which results in the pressure which is required to achieve the necessary line force can be kept relatively low. In comparison with pressing using individual pistons, lower pressure levels of the pressure fluid are possible.

The risk of leakage of the pressure fluid is practically precluded. Moreover, reduced manufacturing expenditure and simple assembly result.

The pressure element can be configured, in particular, as a lifting cushion or pressure cushion or as a pressure tube.

In one preferred practical embodiment of the pressing device according to the invention, the pressure element is configured in the form of a folding bellows. Here, the folding bellows can have a plurality of, for example three, outer folds which are preferably circumferential, by which a relatively small initial height is achieved.

The pressure element can have, in particular, a generally cuboidal design.

However, the pressure element can also be formed by a pressure tube which extends preferably axially.

That pressing surface of the pressure element which acts on the pressure shoe or its lower part preferably corresponds at least substantially to the maximum pressure element cross section. This results in a pressing surface which is as large as possible, as a result of which the pressure which is required to achieve the necessary line force can be kept as small as possible.

A plurality of pressure elements which follow one another in the machine running direction and/or a plurality of pressure elements which follow one another in the transverse direction are advantageously provided.

In one expedient practical embodiment having a plurality of pressure elements which follow one another in the machine running direction, in order to vary the line force profile and/or pressure longitudinal profile in the press nip which is formed with the backing surface, the pressure elements can be acted on with pressure fluid at least partially independently of one another.

In one expedient practical embodiment having a plurality of pressure elements which follow one another in the transverse direction, in order to vary the line force profile and/or transverse pressure profile in the press nip which is formed with the backing surface, the pressure elements which follow one another in the transverse direction can be acted on with pressure fluid at least partially independently of one another.

At least three pressure elements which follow one another in the transverse direction are advantageously provided, as a result of which, for example, control in the edge zones is also made possible.

Pressure elements having different lengths can be provided for adaptation to the respective working width.

In one preferred practical embodiment of the pressing device according to the invention having at least three pressure elements which follow one another in the transverse direction, the two pressure elements on the edges have a smaller length, measured in the transverse direction, than the central pressure element or elements.

In order to form a modular system, in accordance with a further refinement of the invention, pressure elements can be provided which have a length which corresponds to a fraction of a working width. Depending on the working width, more or less pressure elements of this type can be arranged behind one another or next to one another. If required, compensation pressure elements having a smaller length are used, in order to fill a remaining part of the working width.

The pressure element preferably has one or more connections to the pressure fluid supply mechanism. Here, ventilation and/or cooling and/or heating of the pressure element is also advantageously possible via the least one connection.

Water, gas, air and/or oil can be provided as pressure fluid, for example.

In one expedient practical embodiment of the pressing device according to the invention, the pressure element is mounted in a pressure bed of the supporting body. This is possible in all vertical and horizontal directions. Here, the pressure element can be fixed, in particular, by a corresponding design of the pressure bed and of the pressure shoe lower part.

The pressure shoe is advantageously assigned at least one return element, by which it can be moved away from the backing surface. Relatively sensitive transverse profiling is possible as a result of a suitable combination of pressure element or pressure elements and return element or return elements.

A respective return element can comprise, in particular, at least one spring element and/or at least one cylinder/piston element.

The length and shape of the pressure element are expediently defined at least partially by stops.

A stop bar can be provided in the center of the working width, for example. As a result, movements of the pressure shoe unit in the working width direction can advantageously be suppressed, and at the same time the deformation-free thermal expansion of the pressure shoe lower part can be permitted. A plurality of stop bars can also be provided, for example in each case on the outer sides of the pressure shoe.

The stop bar can also be provided with sliding strips which can preferably be exchanged, in order to reduce the friction between the stop bars and the bellows or the supporting body.

The stop bar in the center of the working width is preferably configured to be longer than the other stops. Moreover, the stop bar is preferably guided in a U-shaped stop in the center of the working width.

The brackets which serve to connect with the pressure fluid supply mechanism are expediently arranged on that side of the pressure element which faces away from the pressure shoe.

Moreover, it is advantageous for the connections to the pressure fluid supply mechanism to be arranged diagonally relative to the pressure element. In the case of adjacent pressure elements, the brackets are preferably connected to one another in pairs, in particular in an alternating manner on the inlet/outlet side. This results in short connecting paths.

It is also preferred for the connection to be provided below the supporting body upper belt, that is to say its horizontal part, and/or next to the web of the supporting body, that is to say its vertical part. The connections can be accommodated here in a protected manner and do not require any additional space.

The pressure element is preferably composed at least partially of fiber reinforced plastic.

According to a further refinement of the invention, the pressure shoe can be mounted rotatably in the machine running direction, to be precise, in particular, centrally. Moreover, the pressure shoe can also be mounted in the machine transverse direction, in particular in a multiple manner. This has the advantage that a defined position of the pressure shoe results, without stop bars being required. As a result, the pressure shoe is given a position which can be calculated exactly, and the pressure profile can also be calculated exactly. Furthermore, the rotatable mounting can for its part be mounted so as to move freely in the horizontal direction.

According to the invention, two or more pressure elements can also be arranged one above another. Here, one or more dividing plates are preferably arranged between the pressure elements. Pressure pistons can also be provided instead of the lower pressure elements, at least partially. In this way, further variation possibilities and setting possibilities can be realized.

The solution according to the invention is used, in particular, in dewatering devices in machines for manufacturing and/or finishing paper webs, paperboard webs, tissue webs or other fibrous webs. Here, the fibrous web is guided, together with at least one dewatering belt, through a press nip which is formed with the aid of the pressing device. The line force in the press nip preferably lies between 50 and 980 KN and, in particular, between 60 and 210 KN. The use is therefore particularly suitable for the manufacture of tissue webs.

BRIEF DESCRIPTION OF THE DRAWINGS

The invention will be explained in greater detail in the following text using exemplary embodiments with reference to the drawing, in which.

DETAILED DESCRIPTION

Figure 1:
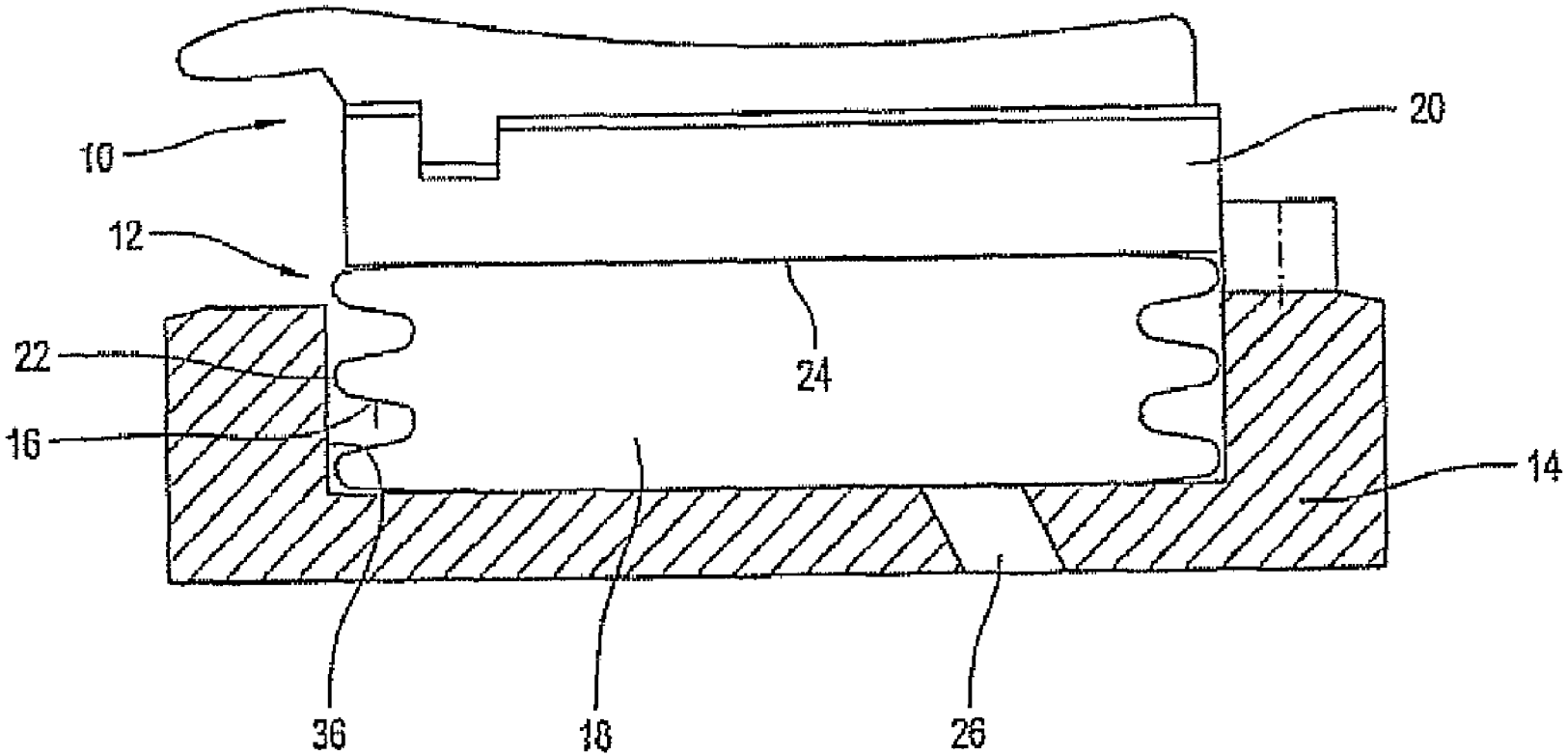
FIG. 1 shows a diagrammatic cross-sectional illustration of a pressure shoe having an associated pressing device.

In a diagrammatic cross-sectional illustration, FIG. 1 shows a pressure shoe 10 having an associated pressing device 12.

The pressing device 12 comprises at least one pressure element 16 which is supported on a supporting body 14 and is flexible at least in regions. The pressure element 16 has at least one hollow space 18 which can be acted on with pressure fluid, in order to produce a predefinable pressing force via a corresponding pressure element volume.

In the present case, the pressure element 16 has only a single, continuous hollow space 18.

A flexible belt, for example the flexible press cover of a shoe roll, can be guided over the pressure shoe 10. Via the pressing unit which acts on the lower part 20 of the pressure shoe 10, the pressure shoe 10 and thus the relevant flexible belt can be pressed against a backing surface which can be formed, for example, by a backing roll, in order to form an extended press nip.

The pressure element 16 which is configured as a lifting cushion or pressure cushion in the present case is configured to be practically leakfree. As can be seen from FIG. 1, it is configured in the present case in the form of a folding bellows having, for example, three outer folds 22 which are preferably circumferential.

The pressure element 16 is to have as large a pressing surface 24 as possible which acts on the pressure shoe 10 or its lower part 20, in order to keep the pressure which is required to achieve the necessary line force as low as possible. This is achieved with the pressure element 16 according to the invention.

The pressure element 16 can, for example, have a generally cuboidal design. That pressing surface 24 of the pressure element 16 which acts on the pressure shoe 16 or its lower part 20 can correspond at least substantially to the maximum pressure element cross section.

Moreover, a connection 26 to the pressure fluid supply mechanism is to be seen in FIG. 1.

Figure 2:
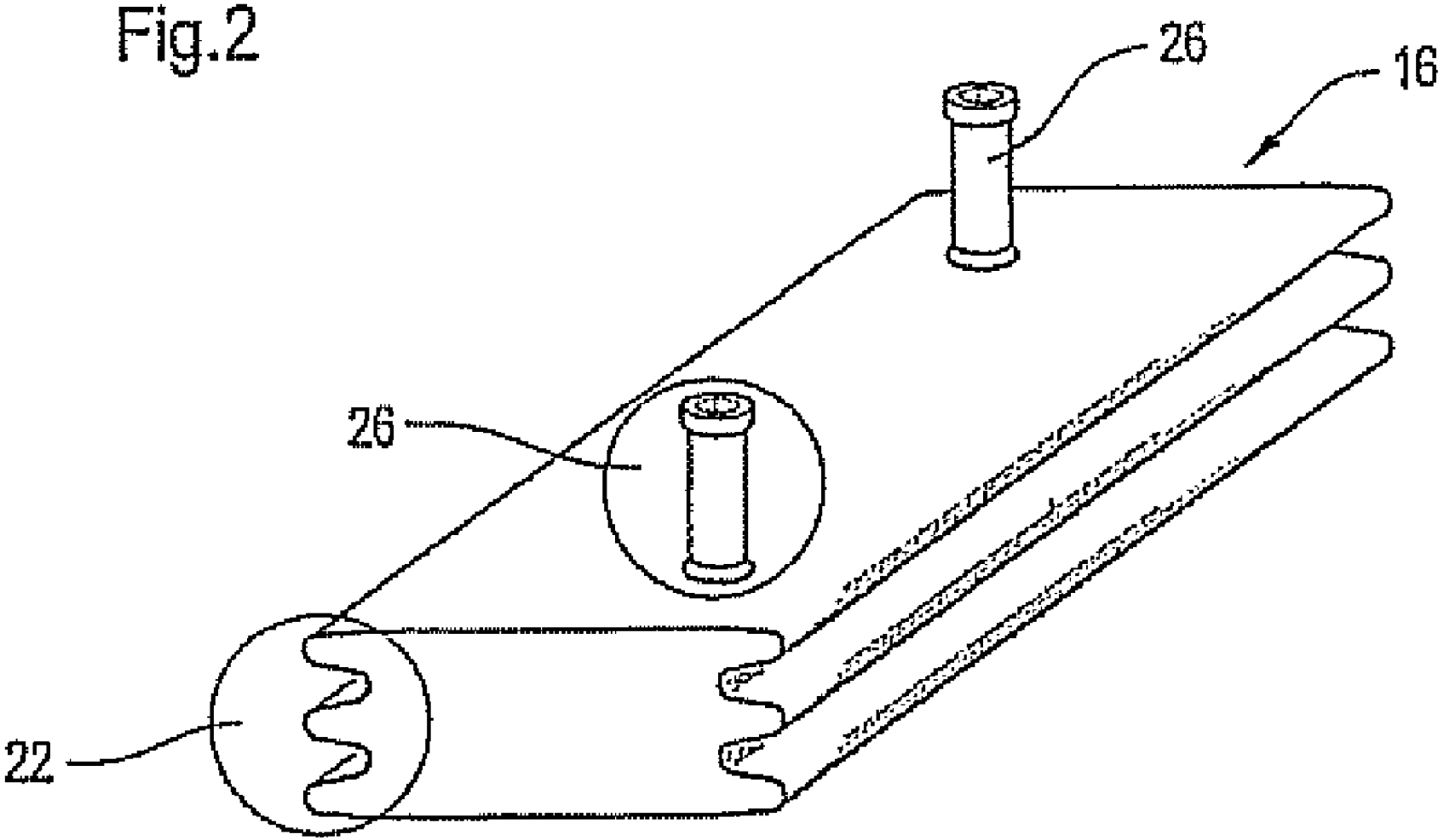
FIG. 2 shows a diagrammatic illustration of the pressure element which is shown in FIG. 1, in a view from below.

As results from FIG. 2, the pressure element 16 can in principle also have a plurality of connections 26 to the pressure fluid supply mechanism. In the present case, two connections 26 of this type are provided. As is to be seen from FIG. 2, the brackets which serve to connect with the pressure fluid supply mechanism are expediently arranged on that side of the pressure element 16 which faces away from the pressure shoe 10 (cf. also FIG. 1). Here, a diagonal arrangement of these brackets can be provided for improved throughflow of the pressure fluid.

The pressure element 16 can expediently be acted on with the relevant pressure fluid in a variable manner, in order to produce a pressing force which can be set in a variable manner by a corresponding variation of the pressure element volume.

Figure 3:
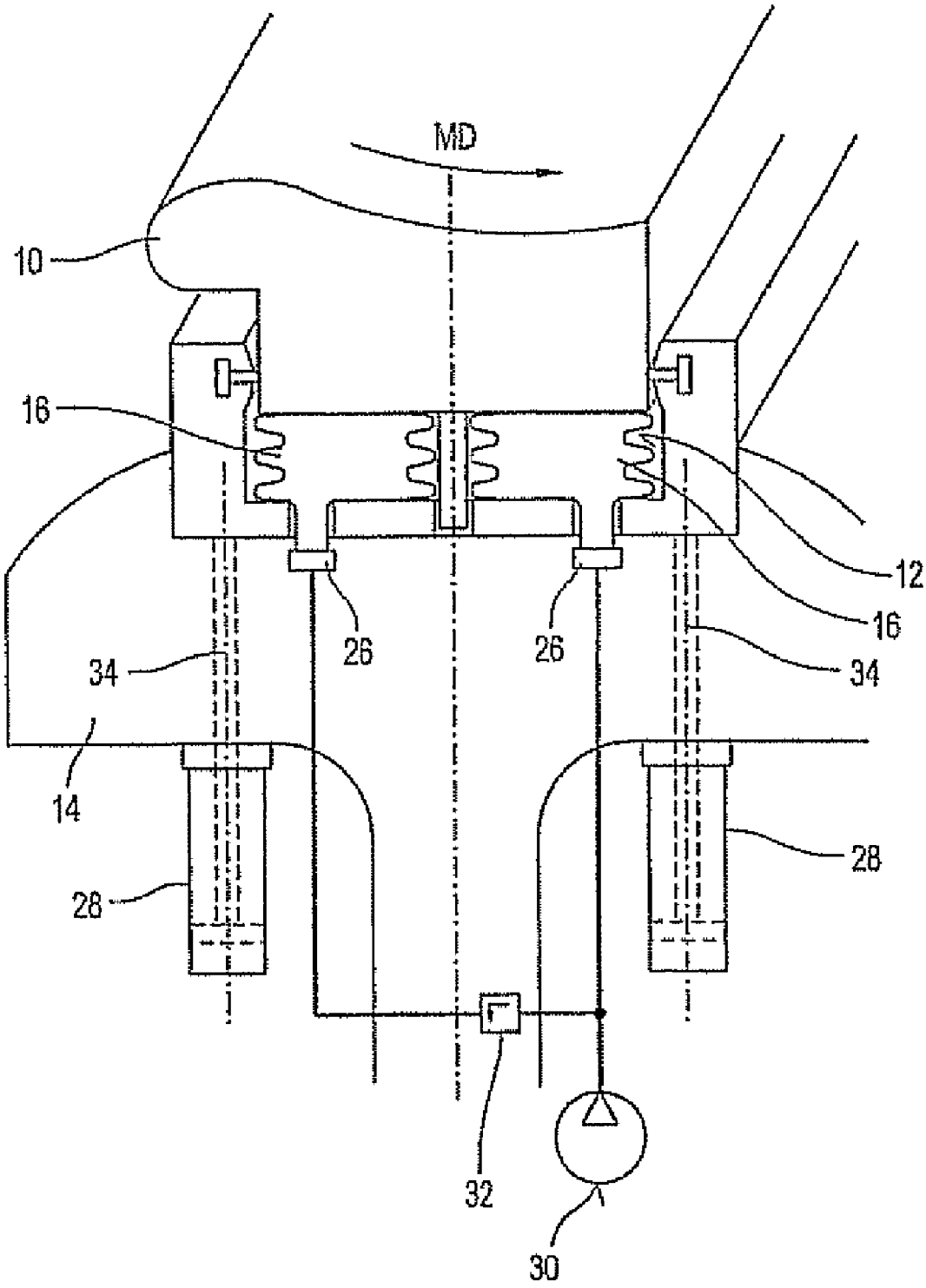
FIG. 3 shows a diagrammatic illustration of a further embodiment of the pressing device having two pressure elements which follow one another in the machine running direction and restoring elements which are assigned to the pressure shoe.
Figure 4:
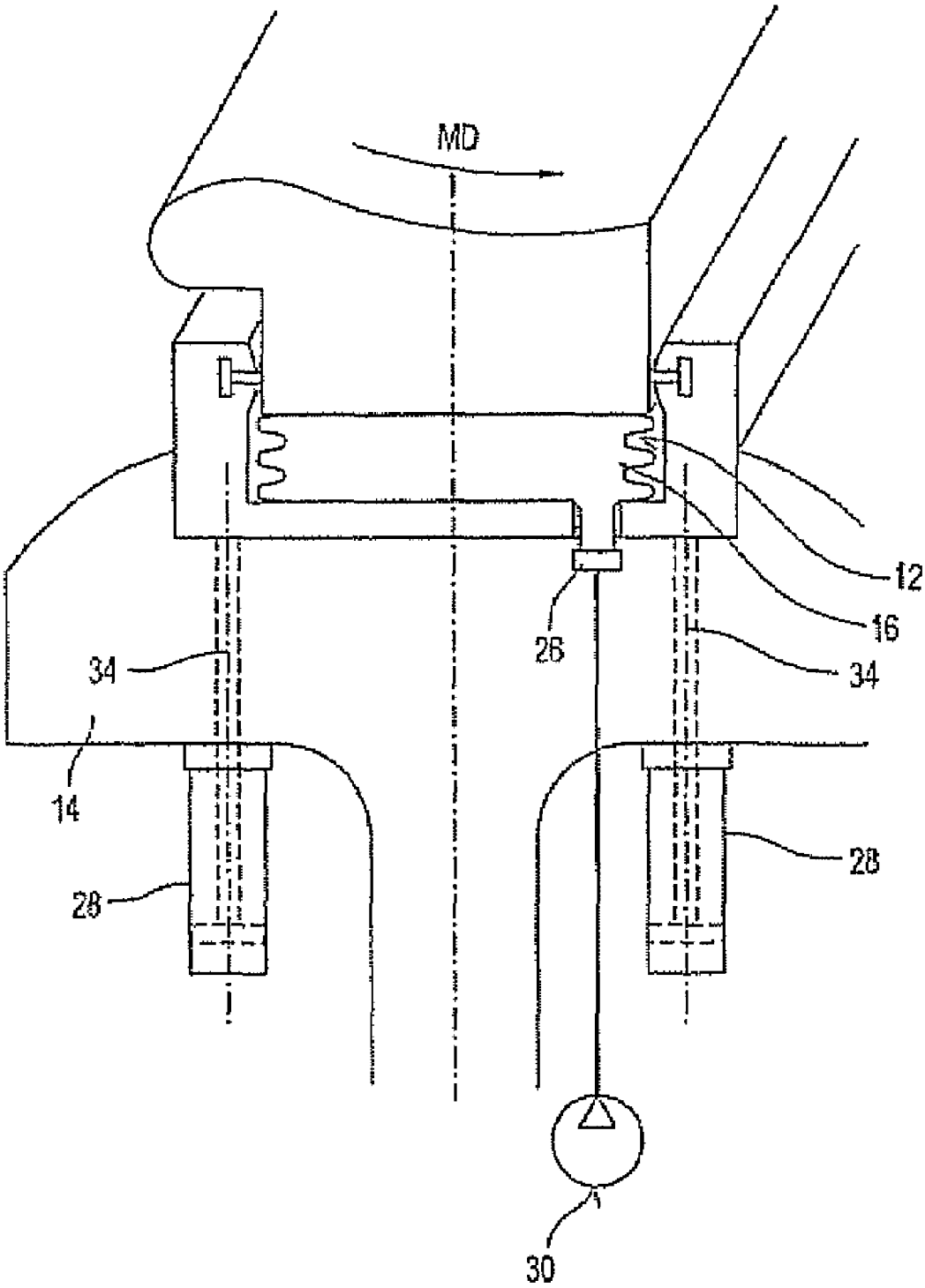
FIG. 4 shows a diagrammatic illustration of a further embodiment of the pressing device having only one pressure element, as viewed in the machine running direction, the pressure shoe also being assigned restoring elements in this case again.
Figure 5:
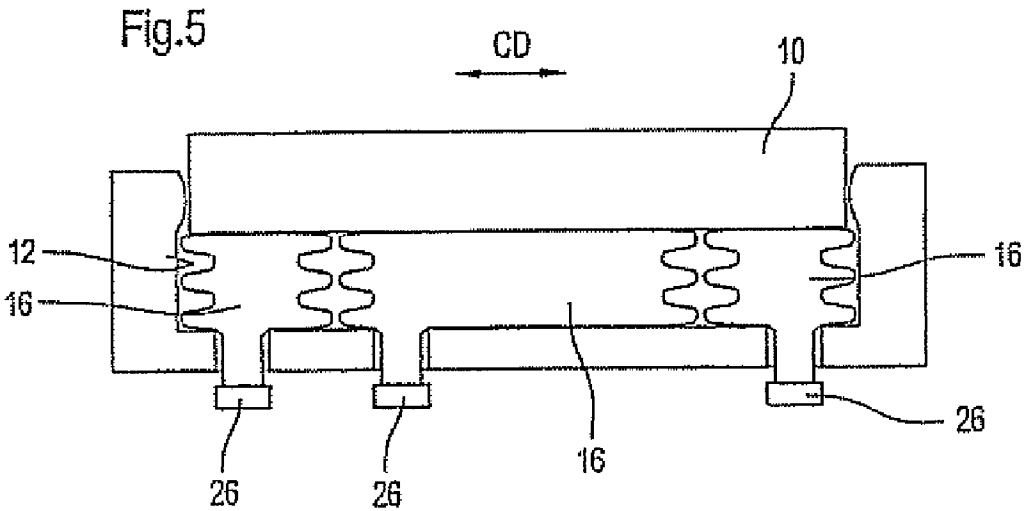
FIG. 5 shows a diagrammatic illustration of an embodiment of the pressing device having three pressure elements which follow one another in the transverse direction.

As results from FIGS. 3 to 5, a plurality of pressure elements 16 which follow one another in the machine running direction MD and/or a plurality of pressure elements 16 which follow one another in the transverse direction CD can be provided.

FIG. 3 shows a diagrammatic illustration of an embodiment of the pressing device 12 having two pressure elements 16 which follow one another in the machine running direction MD, and also having return or restoring elements 28 which are assigned to the pressure shoe 10.

The pressure elements 16 which follow one another in the machine running direction MD are provided with separate connections 26 to the pressure fluid source 30. Here, these pressure elements 16 which follow one another in the machine running direction MD can be acted on with pressure fluid, in particular independently of one another, in order to vary the line force profile and/or longitudinal pressure profile in the press nip which is formed with the backing surface. In the present case, although the pressure elements 16 are connected to the same pressure fluid source 30, a pressure reducing valve 32 or the like, for example, can be provided in the feed line to one of the two pressure elements 16, with the result that the two pressure elements 16 can be acted on with different pressures if required.

As is to be seen from FIGS. 3 and 4, return or restoring elements 28 can be provided both on the front side and on the rear side of the pressure shoe 10, as viewed in the machine running direction, in order to move the pressure shoe 10 away from the backing surface.

A respective return element 28 can, for example, comprise at least one spring element and/or at least one cylinder/piston element.

FIG. 4 shows a diagrammatic illustration of an embodiment of the pressing device 12 having only one pressure element 16, as viewed in the machine running direction MD. In this case, the pressure shoe 10 is also again assigned return elements 28. In the present case, a respective return element 28 can also again comprise, for example, at least one spring element and/or at least one cylinder/piston element.

As is to be seen from FIGS. 3 and 4, the return elements 28 can be provided on that side of the supporting body 14 which faces away from the pressure shoe 10, and can be connected to the pressure shoe 10 via pulling elements 34 which extend through the supporting body 14.

As is to be seen from FIG. 4, the pressure element 16 is again provided with at least one connection 16 to the pressure fluid supply mechanism 30.

FIG. 5 shows a diagrammatic illustration of an embodiment of the pressing device 12 having three pressure elements 16 which follow one another in the transverse direction CD.

In order to vary the line force profile and/or transverse pressure profile in the press nip which is formed with the backing surface, the pressure elements 16 which follow one another in the transverse direction CD can be acted on with pressure fluid, in particular again independently of one another. They are therefore again provided with separate connections 26 to the pressure fluid supply mechanism.

In the present case, for example, three pressure elements 16 are provided which follow one another in the transverse direction CD; however, more than three or only two pressure elements 16 can also follow one another in the transverse direction.

In particular, a combination of the embodiments according to FIGS. 3 and 4 with the embodiment according to FIG. 5 is also conceivable.

Figure 6:
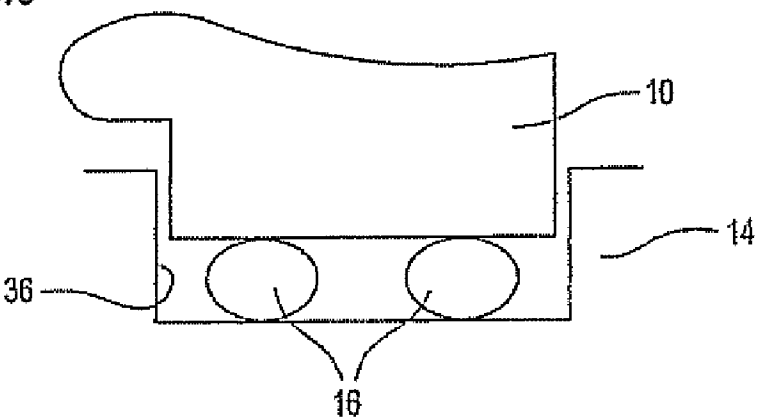
FIG. 6 shows a diagrammatic illustration of an embodiment having a pressure tube.

In FIG. 6, the pressure shoe 10 is pressed via two pressure elements 16 which lie next to one another in the pressure bed 36 in the direction of rotation, in the form of axially extending pressure tubes. The expansion of the pressure tube in the pressing direction is also set here via the pressure of the pressure fluid in the pressure tube.

Pressure elements 16 having different lengths can be provided for adaptation to the respective working width.

If at least three pressure elements 16 which follow one another in the transverse direction CD are provided, it is possible to control the edge zones, for example, via the pressure elements 16 at the edges. As is to be seen from FIG. 5, the pressure elements 16 at the edges can have, for example, a smaller length, measured in the transverse direction, than the central pressure element or elements 16.

The length and shape of the pressure elements 16 can be limited, in particular, by stops.

That pressing surface of a respective pressure element 16 which faces the pressure shoe 10 is relatively great, with the result that the required oil pressure is kept correspondingly low. The brackets for connection to the pressure fluid supply means are arranged on the underside of a respective pressure element 16 (cf. FIG. 2). Here, the brackets can be arranged diagonally for improved pressure fluid throughflow (cf., in particular, FIG. 2 again). The respective displacement results from a change in volume by opening of the folds 22 (cf., in particular, FIG. 1). The result is a correspondingly lower initial height with a limited number of outer folds 22 (cf. the embodiment according to FIG. 1 having only three outer folds). The pressure elements 16 can, in particular, be composed of fiber reinforced plastic or the like.

A respective pressure element 16 can be mounted in a pressure bed 36 of the supporting body 14 (cf., in particular, FIG. 1). Here, the pressure element 16 can be fixed by a corresponding design of the pressure bed 36 and of the pressure shoe lower part 20.

Figure 7:
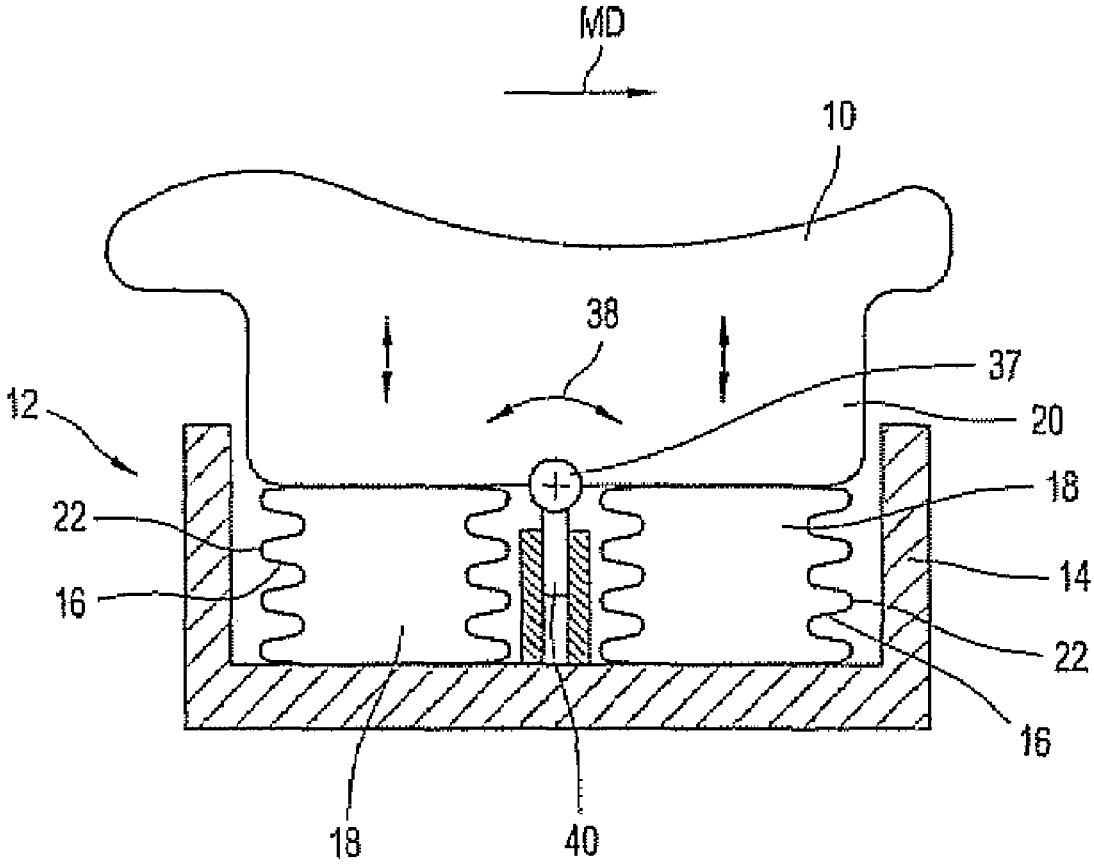
FIG. 7 shows an illustration, corresponding to FIG. 1, of a further variant of the invention.

FIG. 7 shows a pressure shoe 10 which is mounted rotatably via a bearing element 36 in the machine running direction MD, as indicated by arrow 38. For its part, the mounting 36 is mounted so as to move freely in a horizontal bearing 40. In this refinement, as shown, two pressure elements 16 are arranged one behind another in the machine running direction MD. In addition, there can also be provision for a rotatable mounting in the machine transverse direction CD, preferably in a multiple manner, which is not shown here.

Figure 8:
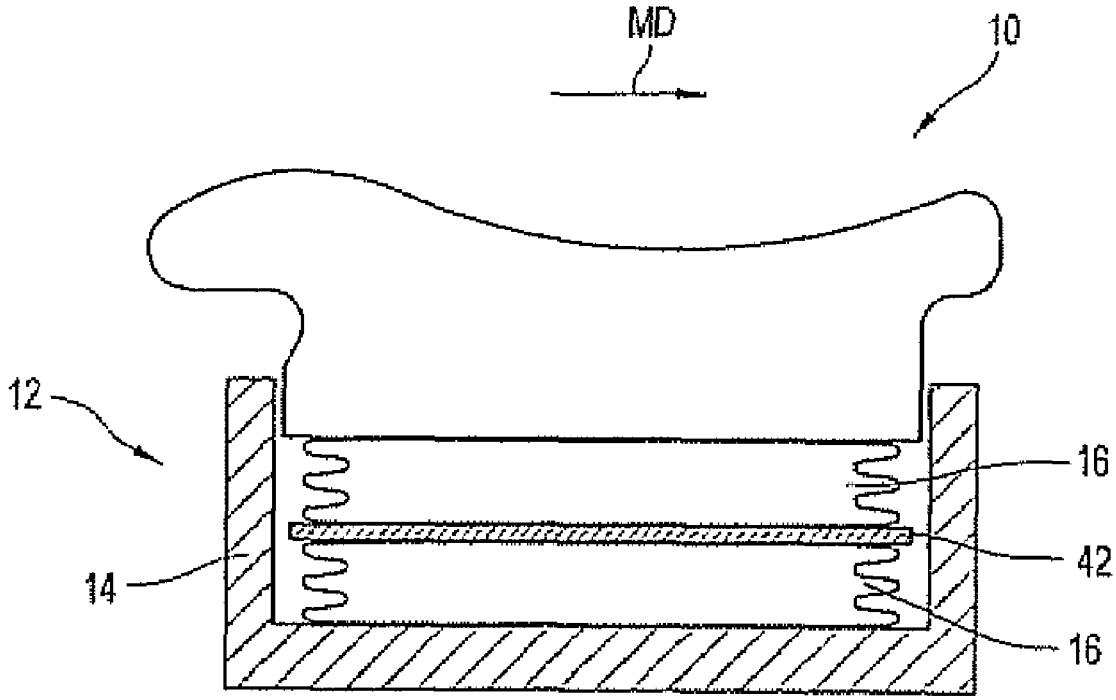
FIG. 8 shows an illustration according to FIG. 1 of yet another variant of the invention.

FIG. 8 shows a variant, in which two pressure elements 16 are arranged one above another. A dividing plate 42 is provided between the two pressure elements 16. Instead of the lower pressure element 16, it is also possible for pressure pistons to be provided. Moreover, a plurality of pressure elements 16 can be arranged next to one another, in each case in the machine transverse direction CD, as has been described with respect to the previous exemplary embodiments. The same is true for the variant of FIG. 7.

LIST OF DESIGNATIONS

10 Pressure shoe
12 Pressing device
14 Supporting body
16 Pressure element
18 Hollow space
20 Lower part
22 Outer fold
24 Pressing surface
26 Connection
28 Return or restoring element
30 Pressure fluid source
32 Pressure reducing valve
34 Pulling element
36 Pressure bed
37 Mounting
38 Arrow
40 Horizontal bearing
42 Dividing plate
MD Machine running direction
CD Transverse direction

The invention claimed is:

1. A device for pressing at least one pressure shoe against a backing surface, the device comprising:
a supporting body;
at least two pressure elements, having at least flexible regions and hollow spaces supported on the supporting body;
wherein the hollow spaces are arranged to be acted on with pressure fluid to produce a predefinable pressing force;
wherein the at least two pressure elements have different lengths in a working width direction;
wherein the at least two pressure elements are sized to a respective working width; and
wherein the at least two pressure elements are arranged to follow one another in a machine running direction.

2. A device for pressing at least one pressure shoe against a backing surface, the device comprising:
a supporting body;
at least two pressure elements, having at least flexible regions and hollow spaces supported on the supporting body;
wherein the hollow spaces are arranged to be acted on with pressure fluid to produce a predefinable pressing force;
wherein the at least two pressure elements have different lengths in a working width direction;
wherein the at least two pressure elements are sized to a respective working width; and
wherein a stop bar is provided in at least one of a center of the working width and on outer sides of the at least one pressure shoe.

3. A device for pressing at least one pressure shoe against a backing surface, the device comprising:
a supporting body;
at least two pressure elements, having at least flexible regions and hollow spaces supported on the supporting body;
wherein the hollow spaces are arranged to be acted on with pressure fluid to produce a predefinable pressing force;
wherein the at least two pressure elements have different lengths in a working width direction;
wherein the at least two pressure elements are sized to a respective working width; and
wherein a length and shape of at least one pressure element of the at least two pressure elements are defined at least partially by stops.

4. The pressing device as claimed in claim 2, wherein the stop bar is provided with exchangeable sliding strips.

5. The pressing device as claimed in claim 2, wherein a stop bar in the center of the working width is longer than other stops.

6. The pressing device as claimed in claim 2, wherein a stop bar is guided in the center of the working width in a U-shaped stop.

7. The pressing device as claimed in claim 1, wherein at least one pressure element of the at least two pressure elements has at least one connection to a pressure fluid supply mechanism, further comprising brackets connecting with the pressure fluid supply mechanism, wherein the brackets are arranged on a side of at least one pressure element of the at least two pressure elements, the side facing away from the at least one pressure shoe.

8. A device for pressing at least one pressure shoe against a backing surface, the device comprising:
a supporting body;
at least two pressure elements, having at least flexible regions and hollow spaces supported on the supporting body;
wherein the hollow spaces are arranged to be acted on with pressure fluid to produce a predefinable pressing force;
wherein the at least two pressure elements have different lengths in a working width direction;
wherein the at least two pressure elements are sized to a respective working width; and
wherein at least one pressure element of the at least two pressure elements has at least one connection to a pressure fluid supply mechanism,
wherein the at least one connection to the pressure fluid supply mechanism comprises at least two connections, and
wherein the at least two connections are arranged diagonally relative to at least one pressure element of the at least two pressure elements.

9. A device for pressing at least one pressure shoe against a backing surface, the device comprising:
a supporting body;
at least two pressure elements, having at least flexible regions and hollow spaces supported on the supporting body;
wherein the hollow spaces are arranged to be acted on with pressure fluid to produce a predefinable pressing force;
wherein the at least two pressure elements have different lengths in a working width direction;
wherein the at least two pressure elements are sized to a respective working width;
wherein at least one pressure element of the at least two pressure elements has at least one connection to a pressure fluid supply mechanism, further comprising brackets connecting with the pressure fluid supply mechanism, wherein the brackets are arranged on a side of at least one pressure element of the at least two pressure elements, the side facing away from the at least one pressure shoe; and wherein the brackets of adjacent pressure elements of the at least two pressure elements are connected to one another in pairs.

10. The pressing device as claimed in claim 9, wherein the brackets of adjacent pressure elements are connected to one another in pairs in an alternating manner on an inlet/outlet side.

11. A device for pressing at least one pressure shoe against a backing surface, the device comprising:

a supporting body;

at least two pressure elements, having at least flexible regions and hollow spaces supported on the supporting body;

wherein the hollow spaces are arranged to be acted on with pressure fluid to produce a predefinable pressing force;

wherein the at least two pressure elements have different lengths in a working width direction;

wherein the at least two pressure elements are sized to a respective working width; and wherein two or more of the at least two pressure elements are arranged one above another.

12. The pressing device as claimed in claim 11, wherein one or more dividing plates are arranged between the two or more of the at least two pressure elements arranged one above another.

13. A device for pressing at least one pressure shoe against a backing surface, the device comprising:

a supporting body;

at least two pressure elements, having at least flexible regions and hollow spaces supported on the supporting body;

wherein the hollow spaces are arranged to be acted on with pressure fluid to produce a predefinable pressing force;

wherein the at least two pressure elements have different lengths in a working width direction;

wherein the at least two pressure elements are sized to a respective working width; and further comprising pressure pistons, wherein the pressure pistons are arranged at least partially between at least one of the at least two pressure elements and the supporting body.

14. A method comprising:

positioning at least one pressure shoe adjacent a backing surface;

wherein the at least one pressure shoe includes a supporting body and at least two pressure elements, having flexible regions and hollow spaces supported on the supporting body, wherein the at least two pressure elements have different lengths in a working width direction, wherein the at least two pressure elements are sized to a respective working width, and wherein the at least two pressure elements are arranged to follow one another in a machine running direction; and applying pressure fluid to the hollow spaces to produce a predefinable pressing force of the at least one pressure shoe against the backing surface.

15. A device for pressing a pressure shoe against a backing surface, comprising:

a supporting body;

at least two pressure elements, having at least flexible regions and at least one hollow space supported on the supporting body;

wherein the at least one hollow space is arranged to be acted on with pressure fluid to produce a predefinable pressing force via a corresponding pressure element volume;

wherein the at least two pressure elements follow one another in a machine running direction; and wherein the at least two pressure elements are arranged to follow one another in a transverse direction.

16. The pressing device as claimed in claim 15, wherein at least one pressure element of the at least two pressure elements is configured to be leak free.

17. The pressing device as claimed in claim 15, wherein at least one of the at least two pressure elements comprises one of a lifting cushion and pressure cushion.

18. The pressing device as claimed in claim 15, wherein at least one of the at least two pressure elements is formed as a folding bellows.

19. The pressing device as claimed in claim 18, wherein the folding bellows has a plurality of outer folds.

20. The pressing device as claimed in claim 15, wherein at least one of the at least two pressure elements has a generally cuboidal design.

21. The pressing device as claimed in claim 15, wherein at least one of the at least two pressure elements is composed of a pressure tube.

22. The pressing device as claimed in claim 15, wherein the at least one pressure shoe further comprises a lower part, and wherein at least one pressure element of the at least two pressure elements further comprises a pressing surface, wherein the pressing surface acts on one of the at least one pressure shoe and the lower part, and wherein the pressing surface corresponds at least substantially to a maximum cross section of the at least one pressure element.

23. The pressing device as claimed in claim 15, wherein the at least two pressure elements are structured to be acted on with pressure fluid in a variable manner, to produce a variable pressing force corresponding to a variation of the pressure element volume.

24. The pressing device as claimed in claim 15, wherein, in order to vary at least one of a line force profile and longitudinal pressure profile in a press nip which is formed with the backing surface, the pressure elements following one another in the machine running direction are acted on with pressure fluid at least partially independently of one another.

25. The pressing device as claimed in claim 15, wherein, in order to vary at least one of a line force profile and a transverse pressure profile in a press nip which is formed with the backing surface, the pressure elements following one another in the transverse direction are acted on with pressure fluid at least partially independently of one another.

26. The pressing device as claimed in claim 15, wherein at least one pressure element of the at least two pressure elements has at least one connection to a pressure fluid supply mechanism.

27. The pressing device as claimed in claim 26, wherein the at least one pressure element can be at least one of ventilated, cooled and heated via the at least one connection.

28. The pressing device as claimed in claim 15, wherein at least one of water, gas, air and oil is provided as pressure fluid.

29. The pressing device as claimed in claim 15, wherein at least one pressure element of the at least two pressure elements is mounted in a pressure bed of the supporting body.

30. The pressing device as claimed in claim 29, wherein the at least one pressure element is fixed by a corresponding design of the pressure bed and of a pressure shoe lower part.

31. The pressing device as claimed in claim 15, wherein the at least one pressure shoe comprises at least one return element, by which the at least one pressure shoe can be moved away from the backing surface.

32. The pressing device as claimed in claim 31, wherein the at least one return element comprises at least one of a spring element, a cylinder and a piston element.

33. The pressing device as claimed in claim 26, wherein the at least one connection is provided at least one of below a supporting body upper belt and next to a web of the supporting body.

34. The pressing device as claimed in claim 15, wherein at least one pressure element of the at least two pressure elements is composed at least partially of fiber reinforced plastic.

35. The pressing device as claimed in claim 15, wherein the at least one pressure shoe is mounted rotatably by a rotatable mounting in a machine running direction.

36. The pressing device as claimed in claim 15, wherein the at least one pressure shoe is mounted rotatably in a machine transverse direction.

37. The pressing device as claimed in claim 35, wherein the rotatable mounting is mounted so as to move freely in a horizontal direction.

38. The pressing device as claimed in claim 19, wherein the outer folds are circumferential.

39. The pressing device as claimed in claim 21, wherein the pressure tube extends axially.

40. The pressing device as claimed in claim 35, wherein the at least one pressure shoe is mounted centrally.

41. The pressing device as claimed in claim 36, wherein the at least one pressure shoe is mounted in a multiple manner.

42. A device for pressing a pressure shoe against a backing surface, comprising:

a supporting body;

at least two pressure elements, having at least flexible regions and at least one hollow space supported on the supporting body;

wherein the at least one hollow space is arranged to be acted on with pressure fluid to produce a predefinable pressing force via a corresponding pressure element volume;

wherein the at least two pressure elements follow one another in a machine running direction; and wherein the at least two pressure elements comprise at least three pressure elements arranged to follow one another in the transverse direction.

43. A device for pressing a pressure shoe against a backing surface, comprising:

a supporting body;

at least two pressure elements, having at least flexible regions and at least one hollow space supported on the supporting body;

wherein the at least one hollow space is arranged to be acted on with pressure fluid to produce a predefinable pressing force via a corresponding pressure element volume;

wherein the at least two pressure elements follow one another in a machine running direction;

wherein the at least two pressure elements comprise at least three pressure elements arranged to follow one another in a transverse direction, wherein the at least three pressure elements comprise two edge pressure elements and at least one central pressure element, and wherein the two edge pressure elements have a smaller length, measured in the transverse direction, than the at least one central pressure element.

44. A device for pressing a pressure shoe against a backing surface, comprising:

a supporting body;

at least two pressure elements, having at least flexible regions and at least one hollow space supported on the supporting body;

wherein the at least one hollow space is arranged to be acted on with pressure fluid to produce a predefinable pressing force via a corresponding pressure element volume;

wherein the at least two pressure elements follow one another in a machine running direction; and wherein, in order to form a modular system, the at least two pressure elements have a length in a transverse direction corresponding to a fraction of the working width.

* * * * *